US005607758A

United States Patent [19]

Schwartz

[11] Patent Number: 5,607,758

[45] Date of Patent: Mar. 4, 1997

[54] SMOKE CONTAINMENT CURTAIN

[75] Inventor: William C. Schwartz, Greensboro, N.C.

[73] Assignee: BGF Industries, Inc., Greensboro, N.C.

[21] Appl. No.: 493,145

[22] Filed: Jun. 21, 1995

[51] Int. Cl.[6] ..... B32B 7/00

[52] U.S. Cl. ..... 442/67; 428/920; 428/921; 442/102; 442/136; 442/180

[58] Field of Search ..... 428/266, 268, 428/273, 920, 921, 251, 297

[56] References Cited

U.S. PATENT DOCUMENTS

| | | | |
|---|---|---|---|
| 4,526,830 | 7/1985 | Ferzinger et al. | 428/268 |
| 4,677,016 | 6/1987 | Ferzinger et al. | 428/212 |
| 4,695,507 | 9/1987 | Schwartz | 428/228 |
| 4,778,544 | 10/1988 | Jones et al. | 156/60 |
| 5,240,058 | 8/1993 | Ward | 160/123 |

OTHER PUBLICATIONS

*Smoke and Fire Prevention Systems*; article entitled Fabric Curtain Boards & Smoke Containment Systems, undated—admitted prior art.

*Primary Examiner*—James J. Bell
*Attorney, Agent, or Firm*—Rhodes, Coats & Bennett, L.L.P.

[57] ABSTRACT

Smoke containment curtains formed of flexible, smoke impermeable fabric formed of a fiberglass fabric substrate coated with a smoke impervious composition on at least one side. The coating includes a halide-free fire retardant incorporated into a halide-free acrylic or silicone resin. The resulting fabric has an $LC_{50}$ of greater than 50 grams.

22 Claims, No Drawings

SMOKE CONTAINMENT CURTAIN

BACKGROUND OF THE INVENTION

The present invention relates to smoke containment curtains or smoke barriers, also known as curtain boards, used to contain smoke within a confined area, such as a ceiling segment or corridor, and especially to smoke containment curtains which emit only low quantities of toxic fumes when subjected to flame.

Fire safety has become a major issue following highly publicized fires during the 1980's in hotels, restaurants, prisons, on airlines and even on ships. These include the MGM Grand Hotel fire in Las Vegas where 85 people died, the Stouffer Hotel fire in Westchester, N.Y., where 26 victims lost their lives, and a cabin fire on an Air Canada flight in which 23 passengers perished. Many of these deaths were caused by toxic smoke and fumes, even though the victims were often far from the fire itself.

The chart below (reprinted from *Progressive Architecture,* September 1984 issue) lists the major toxicants in a fire, their most probable sources, and their effects on humans.

While experts may disagree on the relative toxicity of these various combustion gases, all agree, however, that the less smoke and fumes that are given off in a fire, the better the chance the victims have of surviving the fire.

Various state and federal regulations have been passed to address this concern. For example, every end product used in the construction of public buildings in New York State must be tested and registered for toxicity according to the University of Pittsburgh protocol. The North Carolina Building Code requires the installation of curtain boards in the ceiling of buildings having a floor area in excess of 10,000 square feet in a single expanse. Basically, these curtain boards descend downwardly four to six feet from the ceiling, forming a gridwork of rectangular cells which join other cells dividing the ceiling into zones of, e.g., about 2,000 square feet. During a fire, smoke rising toward the ceiling is collected in the cells and prevented by the curtain boards from spreading. Exhaust fans in the ceiling above the cells can then remove the smoke from the building.

Historically, smoke curtain boards were formed of metal or dry wall panels which were unwieldy to handle and required a complex supporting framework and installation

GASES IDENTIFIED WITH COMBUSTION OF MATERIALS

| TOXICANTS | EXAMPLES OF SOURCE MATERIALS | TOXILOGICAL EFFECTS |
|---|---|---|
| Aldehydes (Arcolein, Acetaloehyde, Furfural, etc.) | Polyethylene Vapor Barriers, Polystyrene Insulation (Hydrocarbons)<br>Wood, Paper, Cardboard (Cellulosics)<br>Urea-Formaldehyde Insulation (Urea-Formaldehyde Polymers)<br>Polyurethane Foams in Furniture and Carpet Underlayment (Urethane Polymers)<br>Polyester Fabrics and Fibers | Potent respiratory irritants |
| Ammonia | Wool, Silk, Nylon, Polyurethane Foam, Melamine in Plastic Laminate (Nitrogen-containing material) | Pungent, unbearable odor; irritant to eyes and nose |
| Carbon Dioxide | Wood, Cotton, Paper (All Carbon-containing materials) | Increases respiration |
| Carbon Monoxide | Wood, Cotton, Paper (All Carbon-containing materials) | Reduces Oxygen carrying capacity of blood |
| Halogen Acids (Hydrobromic Acid, Hydrochloric Acid, Hydrofluoric Acid) | Halon Fire-Retardants<br>Halogenated Plastics and Fire-Retarded Natural and Synthetic materials<br>Polyvinyl Chloride Plastics<br>Brominated Fire-Retarded Polyesters | Respiratory irritants |
| Hydrogen Cyanide | Wool, Silk. Leather, Polyurethane Foam, Paper, Nylon, Urea-Formaldehyde Insulation, Polyacrylonitrile (Nitrogen-containing materials) | A rapidly fatal asphyxiant poison, reduces normal cell metabolism |
| Hydrogen Chloride | Polyvinyl chloride plastics<br>Some Fire-Retardant treated materials | Respiratory irritant; potential toxicity of HCI coated on particulate may be greater than that for an equivalent amount of gaseous HCI |
| Isocyanates | Polyurethane Foam (Urethane Polymers) | Potent respiratory irritants; believed the major irritants in smoke of Isocyanate-based urethanes |
| Nitrogen Oxides | Wood, Nylon, Cellulose, Polyurethane Foam (Nitrogen-containing materials) | Strong pulmonary irritant capable of causing immediate death as well as delayed injury |
| Hydrogen Sulfide Sulfur Dioxide | Polysulfides, Sulfur-crosslinked natural and synthetic rubber (Sulfur-containing materials) | A strong irritant, intolerable well below lethal concentrations |

procedure. A structure overcoming these disadvantages is described in U.S. Pat. No. 5,240,058 to Ward. In the Ward structure, the metal or dry wall boards are replaced by a resin-coated fiberglass fabric with attachment devices such as longitudinal hems sewn into the fabric, which allow the fabric to be supported on a framework of metal pipes. Other flexible products including flame retardant cotton or synthetic fabrics, vinyl films, and laminated or coated materials would probably meet the need for a non-porous, flame retardant, and drapable curtain board material, but these organic based products would quickly lose their structure and shape in a fire scenario and allow the smoke to spread through the building. A suitable fabric is said to be Sandel® fabric (available from Firesafe Products, 276 5th Ave., Suite 300, New York, N.Y. 10001) weighing 8.6 ounces per square yard maximum weight, which is flame retardant anal has d 0.0 CFM air permeability.

Sandel® fabric, originally developed as a mattress ticking, has a structure like the fabric described in U.S. Pat. No. 4,526,830 to Ferziger, and is comprised of a woven fiberglass fabric coated with a polymeric carrier containing a fire retardant. The carrier is a halide-containing resin, such as an acrylic vinyl chloride latex. Suitable fire retardants include aluminum trihydrate, antimony trioxide and antimony pentaoxide. Other ingredients, such as fungicides and bactericides can be added to the coating.

Various other fabrics comprised of a fiberglass substrate fabric and a polymeric coating have been described in the prior art. The properties of these fabrics differ depending on their end use. U.S. Pat. No. 4,677,016 to Ferziger, for example, describes a fabric impermeable to light suitable as a black out curtain or shade, which is comprised of a tightly woven fiberglass fabric substrate coated on at least one surface with an opaque foam coating comprised of a cured layer of flame retardant polymeric latex foam carrier containing a fire retardant. The preferred carrier for these fabrics is also a halide-containing polymer, preferably acrylic vinyl chloride latex. Fire retardants include antimony trioxide and/or antimony pentaoxide, and aluminum trihydrate, which also acts as a filler. A black pigment is added to increase the opacity of the fabric.

U.S. Pat. No. 4,695,507 to Schwartz describes ceiling board facing fabric useful in providing a decorative acoustical surface to ceilings and walls, which has a nubby architectural appearance. The fabric eliminates the spray painting normally required to achieve the three-dimensional nubby appearance. The fabric is comprised of a woven, knitted or non-woven fiberglass substrate fabric formed with textured fill yarns. The fabric is coated with a coating or finish which is essentially free of halogen groups (chlorides, bromides, fluorides), nitrile, nitrate, amine, sulfate, phosphate, and other potentially offending chemical groups which can emit toxic fumes if burned. The finish is preferably an acrylic or silicone resin which contains a non-toxic flame retardant such as aluminum hydrate, and a white pigment. A porous fabric, which is necessary to achieve the desired acoustical properties, is obtained by 1) using an open fabric and then padding the fabric with the low viscosity coating, or 2) knife coating a frothed composition onto the fabric.

U.S. Pat. No. 4,778,544 to Jones et al describes a fabric useful as a facing for Navy board, or hull board, used to form walls and partitions on board ships, and for similar uses. This fabric, which must be rigid, slittable and paintable, is formed by coating a tightly woven fiberglass fabric with a halide-free finish comprised of an acrylic or silicone resin containing a flame retardant and a white pigment.

While the above and other coated fiberglass fabrics have been described in the prior art, some of the fabrics previously disclosed are not suitable for use as a smoke containment curtain or "curtain board" in a structure such as that described in the Ward patent because the fabrics may be too porous or not drapable enough. The products described in the Ferziger patents may be non-porous and drapable, but the halogen finishes can give off toxic hydrochloric acid fumes when heated or burned. Ideally, fabrics for smoke containment curtains should have flexibility and tear resistance, yet should be readily cut and shaped during installation. Such fabrics should be smoke impermeable and, very importantly, should release at most only small amounts of relatively non-toxic fumes when exposed to heat or flame. A fabric having these characteristics would be of great utility in the construction of curtain boards of the type described above, as well as in other barriers to prevent the movement of smoke.

SUMMARY OF THE INVENTION

The present invention provides an improved fabric useful as a smoke curtain, and particularly a flexible, sewable fabric that can be easily fitted and sewn around pipes, ducts and wiring which might otherwise interfere with the positioning of the curtain. The fabric also exhibits a high level of tear resistance during installation and use. Importantly, the curtain is constructed of materials and treated with a fire retardant that do not emit halogen-containing or unacceptable amounts of toxic or irritating fumes when burned.

The fabric is comprised of a fiberglass fabric substrate having certain defined characteristics determined primarily by the diameter of the filaments, the diameter of the yarn, and the construction of the fabric. Of particular importance in the present invention is a substrate which is sufficiently flexible to permit folding and shaping to conform to the dimensions of the area to be covered, or the framework on which the fabric curtain will be supported. The substrate should also result in a fabric that is capable of being easily sewn or otherwise formed into loops or other attachments.

The fabric is preferably woven, but which can be knitted or non-woven. Suitable patterns include fancy, 8 harness satin, or 4 harness satin constructions.

The substrate is coated, preferably on both sides, with a smoke impervious coating. The term smoke impervious is intended to describe a fabric which has zero or nearly zero air impermeability, and includes fabric which have sufficient permeability to allow some air permeability, while blocking the passage of smoke particles. Thus, the curtains can be used in situations where it is desirable to allow some air passage for purposes of humidity or temperature control. Preferably, this smoke impervious coating is applied to both sides of the substrate.

The coating is formed from a resin which will emit only low levels of toxic fumes when burned. These resins consist essentially of carbon, hydrogen and oxygen atoms, and are essentially free of compounds containing nitrogen, sulfur, chlorine, bromine and fluorine atoms, which can produce toxic compounds if the resin is burned. It is especially critical that the coating be essentially free of halogen (chlorine, bromine, fluorine, and iodine) compounds. Thus, the resins are converted into essentially carbon dioxide, carbon monoxide and water when burned. The resin or latex binder can be acrylic, polyester, silicone, polyvinylacetate, polyethylene vinylacetate, or combinations thereof. Acrylic and silicone resins are especially preferred.

Since these resins are flammable when applied to the fabric substrate in sufficient amounts, e.g., normally amounts in excess of 2% by weight of the fabric, the coating also includes a non-toxic flame retardant, such as aluminum hydrate, which can also serve as a filler, a pigment and a smoke suppressant. The aluminum hydrate preferably has a particle size in the range of 1 to 2 microns. Other additives such as softeners, lubricants, wetting agents, and filler may also be included in the coating. Polyethylene or silicone softeners are preferred. Inorganic pigments such as iron oxide yellow, browns or blacks, which emit very little or no times when burned can be added. Even organic pigments can be added as long as they do not give off unacceptable toxic fumes in a fire.

In addition to carefully selecting the finish components for low smoke and toxicity, the amount of binder and other organics in the finish, and the total amount of finish applied to the fabric is kept to a minimum level so as to produce the lowest amount of smoke and fumes in a real fire situation.

The procedure for applying the coating to the substrate is not critical, so long as an air impervious or nearly impervious coating is achieved. One procedure is to apply the coating by immersing the substrate in a bath of the resin and other components, and then removing excess coating by passing the coated substrate between padding rolls which squeeze out excess coating. Such a finishing process will allow the fabric to retain some of its porosity unless the fabric is extremely tightly woven to begin with. If the base fabric is more open and if it is desirable that the final product have zero air permeability, other coating processes such as kiss-coating, roller coating, printing, spraying, or knife coating, may also be used. A combination of these processes can be used or the substrate may be subjected to multiple coatings if desired. The coating may include a thickening agent to produce the desired viscosity for coating. Suitable nontoxic thickeners include cellulosic thickeners and synthetic thickeners such as polyacrylic acid.

Since the materials used in the substrate and coating of the fabric are selected to release no, or very little, toxic fumes when exposed to flame or heat, the resultant fabric will also produce gases or fumes of very little toxicity upon combustion. The methods used to evaluate the toxicity of smoke and fumes given off when a product is burned vary. One test method referenced in Military Specification MIL-M-14 G consists of measuring the concentration of seven potentially toxic gases such as hydrogen chloride, cyanides, carbon monoxide, etc., when a product is subjected to high temperature heating in an enclosed area. The data developed includes the determination of ignition time, burning time, composition of the atmosphere produced, and weight loss of the material. Another method is the "University of Pittsburgh Test for Combustion Product Toxicity" referred to in the background of this invention. The test involves exposing mice to fumes and gases given off by a product as it is heated and burned under controlled conditions. The $LC_{50}$ rating, which is the weight of the product expressed in grams that kills 50% of the mice within 30 minutes as the product burns, is used as the reporting standard. Comparisons can easily be made between different products such as cement, steel, glass, gypsum boards, and plastics used in the building industry. For example, steel, window glass, and uncoated cement do not emit any fumes when heated and therefore they would have $LC_{50}$ ratings above the 300 gram limit of the test. Since the combustion and toxicity properties of wood are fairly well known, wood is often used as a reference point. The $LC_{50}$ rating for Douglas Fir is 64 grams and most woods fall in the 20–200 gram toxicity range. Any $LC_{50}$ rating below 20 grams is considered to be undesirable for a building product since it is "more toxic than wood." Polyvinyl chloride films or pipes, urethane foams, halogenated resins, and many synthetic polymers have $LC_{50}$ ratings in the 10–20 gram range. It is desirable for a building product to be "no more toxic than wood". The products of this invention have $LC_{50}$ ratings that compare favorably with wood (e.g., 58 grams).

Because the bio-assay test may not fully account for the effect of acid fumes, the State of New York requires that, in addition to the $LC_{50}$ rating, the manufacturer must also disclose the percentage of halogens (chlorine, bromine, iodine, fluorine) contained in the product. Furthermore, the product must be tested for flammability by recognized tests such as the ASTM E-84 "Steiner Tunnel Test" for building materials and be classified. The products of this invention have 0.00% chlorine, bromine, fluorine, and iodine and have a flame spread rating of class A per the ASTM E-84 test.

The structure of the curtain will depend on the particular end use, and the structure of any flamework to which the curtain is to be attached. When attached to a flamework of the kind shown in the above Ward patent, the curtain will be of a rectangular shape and will have attachment devices, such as longitudinal hems sewn into the lower edge, and usually the upper edge which allow the curtain to be attached to the framework. Other support structures may employ different configurations, and other attachment means such as grommets, clips and eyelets can be incorporated into the curtain structure.

The curtains may also be used as bunk curtains or portable smoke curtains on naval vessels. In such applications, the need to minimize the release of toxic fumes in especially critical considering the confined area in which the curtains are used.

DESCRIPTION OF THE PREFERRED EMBODIMENT

The fiberglass fabric substrates are woven from fiberglass yarns which are inherently flame retardant. These yarns can be have different physical, chemical, mechanical, thermal and electrical properties, resulting in different properties in the fabric substrate. The chemical composition of the glass is designated by a letter as seen in the table below. Suitable glasses for the present invention include "A", "C", "E", or "S" type or grade. E-glass fiber or "conventional glass fiber" is the most widely available glass fiber available in the U.S.A. for composite reinforcement and it is preferred.

CHEMICAL COMPOSITION OF GLASS FIBER

| CONTENTS IN % BY WEIGHT | | General Purpose Glass E Type | Glass with a resistance to acids A Type | Glass with a resistance to acids C Type | Glass with a resistance to alkalis | | Glass with high mechanical performances R Type | Glass with high mechanical performances S Type | Di-electric Glass D Type | Di-electric Glass Silica |
|---|---|---|---|---|---|---|---|---|---|---|
| Silica | $SiO_2$ | 53 to 54 | 70–72 | 60–65 | 65–70 | 62–75 | 60 | 62–65 | 73–74 | 100 |
| Alumina | $Al_2O_3$ | 14 to 15.5 | 0–2.5 | 2–6 | | 0–6 | 25 | 20–25 | | |
| Lime | CaO | Total: 20–24 | 5–9 | 14 | 4–8 | | 9 | — | .5–.6 | |
| Magnesium | MgO | | 4–1 | 1–3 | | | 6 | 10–15 | | |
| Boron Oxide | $B_2O_3$ | 6.5 to 9 | 0–0.5 | 2–7 | | 0–6 | | 0–1.2 | 22–23 | |
| Fluorine | F | 0 to 0.7 | — | | | | | | | |
| Sodium Oxide | $Na_2O$ | ≦1 | 12–15 | 8–10 | 14–20 | 13–21 | | 0–1.1 | 1.3 | |
| Zirconium Oxide | $ZrO_2$ | | | | | 7–17 | | | | |
| Postassium Oxide | $K_2O$ | | 1 | | 0–3 | | | | 1.5 | |
| Iron Oxide | $Fe_2O_3$ | | | | | 0–5 | | | | |
| Titanium Oxide | $TiO_2$ | | — | | 6–12 | 0–4 | | | | |
| Zinc Oxide | ZnO | | | | | 1–10 | | | | |
| Calcium Fluoride | $CaF_2$ | | | | | 0–2 | | | | |

The fabric used in the smoke curtains described herein is formed of filaments or fibers which have an average diameter of less than about 0.000400 inches, and preferably from about 0.000250 inches to about 0.000375 inches.

It is the normal practice in describing fiberglass filaments to designate the filament diameter by a letter from "C" to "K". The letter "C" designates a filament having a diameter of 0.000175 inch; "DE" designates a diameter of 0.000250 inch; "G" a diameter of 0.00036 inch; and "K" a diameter of 0.000525 inch. The more common "G" and "DE" filaments are preferred in the present substrates as they give a good balance between economics and desired physical properties.

The size or strand count of fiberglass yarns is normally defined by a number designating the length in yards of one pound of yarn. Thus, one pound of yarn designated as "DE-37" will be 3,700 yards long, while one pound of yarn designated "DE-75" will be 7,500 yards long. Larger diameter yarns are less flexible and result in stiffer fabrics. "DE-37" yarns are preferred in the present invention.

Woven fiberglass fabric as it comes off the loom or weaving machine may contain about 1% to 4% by weight of organics in the fabric. About 1% of these organics are applied to the yarn as it is formed from molten glass by the yarn producer as a yarn binder. This binder contains starches, surfactants, oils or lubricants, and other auxiliary chemicals which help protect the glass as it is wound on packages and later unwound in other textile processes. The machine direction or warp yarns may also be sized or slashed with an additional 1% to 5% warp size which may be composed of starches or polyvinyl alcohol, lubricants, humectants, and the like.

It is often useful to remove these organics from the fabric before the desired finish is applied by a process called desizing or heat cleaning the fabric. Although this process weakens the fabric, it leaves behind a more consistent substrate which is more receptive to various finishes. The heat cleaning process can also make the fabric more flexible and give a softer hand. A heat cleaned fabric substrate is preferred in the present invention since it results in a more flexible and drapable fabric with improved abrasion resistance and other physical properties.

It is often helpful to apply a base finish to the heat cleaned fabric to protect the fabric during further process, as well as to impart a soft hand, strength, and color to the fabric. A typical finish can include a softener, a silane or adhesion promoter, a latex binder, a surfactant, a defoaming agent, and a colored pigment.

The resin used in the coating is also selected to ensure that the fabric will exhibit the flexibility required for a suitable smoke curtain. This flexibility can be expressed by the $T_{300}$ of the resin, which is a measurement of the temperature at which the torsional modulus of an air-dried film is 300 $kg/cm^2$. A higher temperature describes a stiffer film. For example, Rhoplex AC-604, commonly used in the finishing of Navy board fabric, has a $T_{300}$ of 38° C. On the other hand, softer, more flexible, resins of the type used in the present invention will have a negative $T_{300}$ value. Generally, the present resins have a $T_{300}$ of less than about 0° C. and preferably from about −40° C. to about −10° C. For example, Rhoplex K-3, used as a coating in the present invention, has a $T_{300}$ of −32° C.

The desired smoke curtain flexibility can be determined by, and expressed in terms of a standard measurement for fabric stiffness, such as the ASTM D 1388 "Test for Stiffness of Fabric" or the similar Federal Test Method Standard 191: Method 206, "Stiffness of Cloth, Flex and Drape: Cantilever Bending Method." The ASTM test is described as follows:

"A strip of fabric is slid in a direction parallel to its long dimension so that its end projects from the edge of a horizontal surface. The length of the overhang is measured when the tip of the test specimen is depressed under its own weight to the point where the line joining the tip to the edge of the platform makes an angle of 41.5° with the horizontal. One half of this value is the bending length of the specimen. The cube of this quantity multiplied by the weight per unit area of the fabric is the flexural rigidity."

A lower flexural rigidity designates a more flexible fabric. The flexural rigidity can be measured in both the warp and fill directions. In order to satisfy the flexibility requirements of the present products, the fabric should have a flexural rigidity of less than 0.030 in-lbs. in the warp direction and less than 0.015 in-lbs. in the fill direction when tested in accordance with ASTM D 1388.

EXAMPLE 1

A fiberglass fabric substrate manufactured by BGF Industries, Inc., of Greensboro, N.C., as Style 7781 was prepared by heat cleaning to remove yarn binders and warp sizing. This fabric weighs about 8.90SY (ounces per square yard) and has an 8 harness satin weave pattern with a 58×54 construction of ECDE-75½ glass yarns.

A base coating was applied to the substrate by padding and dried to give an organic add-on of about 1.1% based on the fabric weight. The base coating composition was comprised of 8.0 wt. % Rhoplex K-3 acrylic latex, 8.0 wt. % Dow Corning 36 emulsion and 84.0 wt. % water. Rhoplex K-3 is a soft acrylic latex made by Rohm & Haas Company, Philadelphia, Pa. Dow Corning 36 emulsion is an organopolysiloxane manufactured by Dow Corning Corporation, Midland, Mich., as a water repellant and softener.

The fabric, which was soft and non-water repellant, was then coated on both sides with the following composition which was applied with a floating knife:

| | |
|---|---|
| Deionized water | 23 gal. |
| Chemtreat CT-708 | 1 lb. |
| Antifoam H-10 | 0.2 lb. |
| Ammonia | 1 gal. |
| Hydral 710 | 150 lbs |
| Polycryl 7F12 | 10 gal. |
| DC-36 emulsion | 5 gal. |
| Acrysol ASE-60 | 3 gal. |

Chemtreat CT-708 is a dispersing aid for inorganic fillers manufactured by Chemtreat, Inc. of Ashland, Va. Antifoam H-10 is an antifoaming or defoaming chemical from Dow Chemical Corporation. Hydral 710 is a small particle size hydrated alumina distributed by Whitaker, Clarks, and Daniels, Inc. of South Plainfield, N.J. Polycryl 7F12 is a soft acrylic latex manufactured by Morton Chemicals, Inc. of Greenville, S.C. It has a $T_{300}$ value of about −30° C. Acrysol ASE-60 is a polyacrylate thickening agent from Rohm & Haas Company.

The fabric after coating had a weight of 9.90SY with a breaking strength of over 250 lbs/in. in both the warp and fill directions. The air permeability of the fabric was essentially zero cubic feet per minute per square foot as measured by ASTM D 731, "Standard Method of Test for Air Permeability of Textile Fabrics."

The material was tested for flammability and smoke density in accordance with the specifications set forth in ASTM E-84-91a, "Standard Test Method for Surface Burning Characteristics of Building Materials." This test procedure is similar to UL-723, ANSI No. 2.5, NFPA No. 255, and UBC 42-1 and is often referred to as the Steiner Tunnel Test. The test results for the Flame Spread Index was "0" and the smoke developed value was also "0." No ignition was noted in the ten minute exposure to the flame. The specimen exhibited charring but neither after flame nor afterglow were evident upon test completion.

In the Steiner Tunnel Test, the reference base is cement board which has an "0" rating for both flame spread and smoke development, and red oak which has a 100 rating for both flame spread and smoke development. A flame spread of less than 25 and a smoke development of less than 450 are required for a Class A Interior Wall & Ceiling Finish Category as defined by NFPA Life Safety Code 101, Section 6-5.3. Some local fire codes require a smoke rating of less than 50 in addition to the 25 maximum flame spread. The product described in Example I clearly exhibits superior flame resistance and low smoking properties.

Another text frequently required by fire code officials for building products is ASTM E662 (NFPA 258) "Specific Optical Density of Smoke Generated by Solid Materials" (in accordance with the National Bureau of Standards Smoke Density Chamber). The optical density results (DMC) of the Example I fabric averaged 2 or less under Smoldering Thermal Exposure operating conditions and 4 or less under Flaming Thermal Exposure conditions.

Since the product of Example I was to be used as a drapable curtain board fabric in a smoke containment system, the material was also tested for flame resistance per the NFPA 701 Small and Large Scale Tests. The sample showed 0 seconds after flame and 0 flaming residues with a char length of only 0.6 inches in the Small Scale Test. The requirements to pass this Small Scale Test are a 2-second (maximum) after flame, a 0 flame residue, and a 4.5 inch (maximum) char length. The requirements for the Large Scale Test is that a material tested in single sheets shall not continue flaming for more than 2 seconds after the test flame is removed and the vertical spread of burning shall not exceed 10 inches above the top of the test flame. The sample had a 0 second after flame and an average char length of 2 inches, and met the requirements of the test. While not subjected to toxicity testing, it is believed that this material would exhibit an $LC_{50}$ of greater than 50 grams.

EXAMPLE 2

A fiberglass fabric manufactured by BGF Industries as Style 7782 was processed with the same finish as Style 7781 in Example 1. The fabric had the same weight and construction as Style 7781 but had a lined pattern in both the warp and fill directions to make it easier to cut and fabricate the material into curtain board panels. The resultant fabric was checked for drape and flex stiffness in accordance with ASTMD 1388 and compared to a coated fabric commonly used in the manufacture of Navy board. The following results were obtained:

| Fabric Strength | Bending Length (Drape Stiffness) | | Flexural Strength (Flex Stiffness) | |
|---|---|---|---|---|
| Navy Board | Warp | 5.7 in. | Warp | 0.123 in-lbs. |
| | Fill | 4.2 in. | Fill | 0.049 in-lbs. |
| Curtain Board | Warp | 2.9 in. | Warp | 0.012 in-lbs. |
| | Fill | 1.9 in. | Fill | 0.003 in-lbs. |

TOXICITY TESTS

The fabric of Example 2 was submitted for toxicity testing in accordance with the procedures outlined in U.S. Testing Company report #83413 for the Bureau of Ships, U.S. Navy, and referenced in Military Specification MIL-M-14H. Four separate samples of the same facing were tested with the results reported for each sample as well as an average for all four samples:

| TEST DATA | 1 | 2 | 3 | 4 | Average |
|---|---|---|---|---|---|
| Original Weight, g | 13.98 | 11.96 | 13.90 | 15.54 | 13.85 |
| Residual Weight, g | 13.58 | 11.58 | 13.49 | 15.02 | 13.42 |
| Loss in Weight, g | 0.40 | 0.36 | 0.41 | 0.52 | 0.42 |
| Temperature of Coil | (a) | (a) | (a) | (a) | |
| Ignition Time, seconds | | | NO IGNITION | | |
| Heating Time, seconds | 420.0 | 420.2 | 419.9 | 420.1 | 420.1 |
| Temperature of Chamber, °C. | 29 | 31 | 31 | 31 | 31 |
| Beilstein | (b) | (b) | (b) | (b) | |
| Smoke | (c) | (c) | (c) | (c) | |
| Flame | (d) | (d) | (d) | (d) | |
| Ash | (e) | (e) | (e) | (e) | |

NOTES
(a) Equilibrium temperature 649° C.
(b) Negative
(c) Very light amount of light grey smoke
(d) No ignition, no flame
(e) No ash seen

| COMPOSITION OF ATMOSPHERE | 1 | 2 | 3 | 4 | Average |
|---|---|---|---|---|---|
| Hydrogen Chloride | 0 | 0 | 0 | 0 | 0 |
| Aldehydes as HCHO | 0 | <1 | 0 | <1 | <1 |
| Ammonia | 0 | 0 | 0 | 0 | 0 |
| Carbon Monoxide | 40 | 25 | 25 | 40 | 33 |
| Carbon Dioxide | 400 | 500 | 400 | 500 | 450 |
| Oxides of Nitrogen as $NO_2$ | 8 | 15 | 10 | 15 | 12 |
| Cyanides as HCN | 0 | 0 | 0 | 0 | 0 |

Composition of Atmosphere (Gases Emitted)

The toxicity test based on M1L-M-14H specification measures the quantity of seven combustion gases which are considered to be toxic and harmful to humans. These seven gases are also listed as toxicants in the table set out in the Background of the Invention. It will be noted that the material of Example 2 released little or no hydrogen chloride, aldehyde, ammonia, or cyanide fumes when heated to high temperatures. The principal gases given off were carbon dioxide and carbon monoxide which are present when any carbon based organic product such as wood, cotton, or paper are heated and burned. Although this toxicity test does not attempt to detect or measure irritating and toxic gases such as hydrogen sulfide, sulfur dioxide and hydrobromic, hydrochloric and hydrofluoric acid fumes, the products of this invention do not and cannot give off any significant amounts of these gases since the fabric and finish is devoid of sulfur, bromine, chlorine, and fluorine.

Ignition

No ignition was observed even though the material was exposed to temperatures of up to 649° C. (about 1250° F.). Virtually any organic based product including wood, paper, or cotton would ignite and burn under similar conditions and the "no ignition" observation attests to the high flame retardant qualities of this product.

Smoke

Only a "very light amount of light grey smoke" was observed when the product was heated. Since the product has very little organic components capable of giving off smoke, and the flame retardant is aluminum hydrate which gives only water vapor when heated, the fabric of Example 2 and the other products of this invention are highly flame retardant and give off only very small amounts of smoke when heated or exposed to a flame.

Beilstein

The Beilstein test is a qualitative test for halogens and was negative since the product has no chlorides or other halogens.

Weight Loss

The weight loss for the fabric of Example 2 was an average of 0.42 grams with the original weight averaging 13.85 grams. Thus, less than 3.5% of the product weight was consumed under these test conditions. A totally inorganic product such as concrete or metal would show close to a 0% weight loss while an organic product such as wood would show a much higher weight loss (30% or more) depending on the degree or completeness of combustion.

FLAMMABILITY TESTS

The fabric of Example 2 was also tested via ASTM E84-91a "Surface Burning Characteristics of Building Materials" and had a 0 Flame Spread Index and 0 Smoke Developed Value rating.

This report presents test results of Flame Spread and Smoke Developed Values per ASTM E84-91a. The report also includes Material Identification, Method of Preparation, Mounting and Conditioning of the specimens.

The tests were performed in accordance with the specifications set forth in ASTM E84-91a, "Standard Test Method for Surface Burning Characteristics of Building Materials", both as to equipment and test procedure. This test procedure is similar to UL-723, ANSI No. 2.5, NFPA No. 255 and UBC 42-1.

The test results cover two parameters: Flame Spread and Smoke Developed Values during a 10-minute fire exposure. Inorganic cement board and red oak flooring are used as comparative standards and their responses are assigned arbitrary values of 0 and 100, respectively.

One (1) 24"×24'0" sample was placed on a 2-inch hexagonal wire mesh supported by steel rods spanning the width of the tunnel. The sample thickness was 0.012 inches.

The sample was conditioned at 73°±5° Fahrenheit and 50±5% relative humidity.

The tunnel was thoroughly pre-heated by burning natural gas. When the brick temperature, sensed by a floor thermocouple, had reached the prescribed 105° Fahrenheit ±5° Fahrenheit level, the sample was inserted in the tunnel and test conducted in accordance with the standard ASTM E84-91a procedures.

The operation of the tunnel was checked by performing a 10-minute test with inorganic board on the day of the test.

The test results, calculated in accordance with ASTM E84-91a for Flame Spread and Smoke Developed Values are as follows:

| | |
|---|---|
| Test Specimen: | Style 7782 |
| Flame Spread Index: | 0 |
| Smoke Developed Value: | 0 |

No ignition was noted in the ten minute exposure to the flame. The specimen exhibited charring. There was no flamefront advancement. Neither afterflame nor afterglow were evident upon test completion.

The National Fire Protection Association Life Safety Code 101, Section 6-5.3, "Interior wall and Ceiling Finish Classification", has a means of classifying materials with respect to Flame Spread and Smoke Developed when tested in accordance with NFPA 255, "Method of Test of Surface Burning Characteristics of Building Materials", (ASTM E84).

| The classifications are as follows: | |
|---|---|
| Class A Interior Wall & Ceiling Finish: | Flame Spread - 0–25; Smoke Developed - 0–450 |
| Class B Interior Wall & Ceiling Finish: | Flame Spread - 26–75; Smoke Developed - 0–450 |
| Class C Interior Wall & Ceiling Finish: | Flame Spread - 76–200; Smoke Developed - 0–450 |

Since the sample received a Flame Spread of 0 and a Smoke Developed Value of 0 it would fall into the Class A Interior Wall & Ceiling Finish category.

EXAMPLE 3

A fiberglass fabric manufactured by BGF Industries as Style 7721 was processed also with a two-step finish. The weave pattern is "fancy", with a 58×42 construction of ECDE-75½ glass yarns. The base fabric weighs about 7.9 oz/yd$^2$. After the coating is applied it weighs about 9.5 oz/yd$^2$.

The base coating was comprised of:

| COMPONENT | AMOUNT (100 gal. mix) |
|---|---|
| Deionized Water | 74.30 gal |
| Organofunctional Silane A-187 | 570.00 ml |
| Aqua Ammonia 26 Deg Baume | 1000.00 ml |
| Igepal CO-887 Surfactant | 1500.00 ml |
| Foamaster DF-160 L | 100.00 ml |
| Rhoplex K-3 or Rhoplex St 954 | 25.00 gal |

The Silane A-187 is the product of OSI Specialties; Igepal CO-887 is available from Rhone-Poulenc; and Foamaster DF-160 L is the product of Henkel Corporation.

The fabric was then coated on both sides with the following composition:

| COMPONENT | AMOUNT (50 gal. mix) |
|---|---|
| Deionized Water | 23.00 gal |
| Chemtreat CT-708 | 1.00 gal |

-continued

| COMPONENT | AMOUNT (50 gal. mix) |
|---|---|
| Dow Corning Antifoam H-10 | 100.00 ml |
| Aqua Ammonia 26 Deg Baume | 1.00 gal |
| Hydral 710 | 150.00 lbs |
| Metasol TK-100 Dispersion W | 1.00 lbs |
| Polycryl 7F-12 | 14.00 gal |
| Premix from below | 6.50 gal |
| Premix: | |
| Acrysol ASE-60 | 2.5 gal |
| Acrysol ASE-95 | 1.50 gal |
| Deionized Water | 2.00 gal |

The components in the above list are available as follows:

| COMPONENT | SUPPLIER |
|---|---|
| Chemtreat CT-708 | Chemtreat, Inc. |
| Antifoam H-10 | Dow Corning |
| Aqua Ammonia 26 Deg Baume | Various |
| Hydral 710 | Whittaker, Clark & Daniels, Inc. |
| Metasol TK-100 Dispersion W | Calgon Corp. |
| Polycryl 7F12 | Morton International, Inc. |
| Acrysol ASE-60 | Rohm and Haas |
| Acrysol ASE-95 | Rohm and Haas |

SURFACE BURNING CHARACTERISTICS TESTS

Samples were supplied in rolls and were cut to a width of approximately 24 inches. The samples were supported on the ledges of the tunnel with hexagonal pen netting and steel rods placed at 2½ intervals.

The tests were conducted in accordance with Underwriters Laboratories Inc.'s Standard Test Method for Surface Burning Characteristics of Building Materials, UL 723.

The maximum distance the flame spreads along the length of the sample from the end of the igniting flame is determined by observation. The Flame Spread Classification of the material is derived by determining the area under the flame spread distance (ft) versus time (min) curve, ignoring any flame front recession, and using one of the calculation methods as described below:

1. If the total area ($A_\tau$) is less than or equal to 97.5 min-ft (meter-min ×3.3), the Flame Spread Classification shall be 0.515 times the total area (FSC=0.515$A_\tau$).

2. If the total area ($A_\tau$) is greater than 97.5 min-ft (meter-min×3.3), the Flame Spread Classification is to be 4900 divided by 195 minus the total area ($A_\tau$). (FSC=4900/(195-$A_\tau$)

FLAME SPREAD RESULTS

| Test No. | Maximum Flame Spread (ft) | Time of Maximum Flame Spread (ft) | Time of Maximum Flame Spread (min:sec) | Calculated Value For Flame Spread Classification |
|---|---|---|---|---|
| 1 | S/7721 972B Smooth Surface | 1.5 | 7:06 | 4.2 |
| 2 | S/7721 972B Embossed Surface | 1.0 | 2:28 | 4.2 |
| 3 | S/7721 972B Smooth Surface | 1.0 | 2:50 | 4.0 |

The smoke developed during the test is indicated by the output of a photoelectric circuit operating across the furnace flue pipe. A curve is developed by plotting values of light absorption (decreased cell output) against time. The calculated value for Smoke Developed Classification is derived by expressing the net area under the curve for this material as a percentage of the net area under the curve for untreated red oak.

SMOKE DEVELOPED RESULTS

| Test No. | Test Sample | Calculated Value for Smoke Developed Classification |
|---|---|---|
| 1 | S/7721 972B Smooth Surface | 2.9 |
| 2 | S/7721 972B Embossed Surface | 0.7 |
| 3 | S/7721 972B Smooth Surface | 0.3 |

The following conclusions represent the judgment of Underwriters Laboratories Inc. based upon the results of an examination of tests presented in this Report as they relate to established principles in previously recorded data.

| | |
|---|---|
| Flame Spread | 5 |
| Smoke Developed | 0 |

SMOKE DENSITY TEST (ASTM E662)

Sample:

| | |
|---|---|
| Description: | "Coated Fiberglass Fabric, Style 7721 to 7729, 972 Finish" |
| Preconditioning: | 140° F. for 24 Hours |
| Conditioning: | 70 ± 2° F. & 50 ± 2% R.H. for 48 Hours |
| Test Orientation: | Face to Furnace |

Operating Conditions (Smoldering):
Radiometer Rdg. 8.78 mv; Irradiance 2.5 w/cm$^2$, G Factor 132

Thermal Exposure: Smoldering
Furnace Voltage: 110

| | #1 | #2 | #3 | |
|---|---|---|---|---|
| Chbr. Temp. °F. (start) | 95 | 95 | 95 | |
| Chbr. Press, Inches $H_2O$ | Maintained Positive Under 3 | | | |
| Min. Trans. (Tm), % | 88 | 89 | 90 | |
| at, minutes | 10.4 | 10.4 | 12.7 | |
| Max. Spec. Opt. Dens. (Dm) | 7 | 7 | 6 | |
| Clear Beam, Dc. | 1 | 1 | 0 | |
| Avg. | | | | |
| Dm, corrected (Dmc) | 6 | 6 | 6 | 6.0 |
| Spec. Opt. Density at 1.5 min. | 4 | 3 | 2 | 3.0 |
| Spec. Opt. Density at 4.0 min. | 4 | 3 | 2 | 3.0 |
| Time to 90% DM, min. | 5.0 | 6.4 | 8.2 | |
| Time to Ds = 16, min. | — | — | — | |
| Initial Weight, grams | 1.9 | 1.9 | 1.9 | |

Operating Conditions (Flaming):
Radiometer Rdg. 8.78 mv; Irradiance 2.5 w/cm$^2$, G Factor 132

Thermal Exposure: Flaming
Furnace Voltage: 110
Burner Fuel: 500 cc/min. Air, 50 cc/min. Propane

| | #1 | #2 | #3 |
|---|---|---|---|
| Chbr. Temp. °F. (start) | 95 | 95 | 95 |
| Chbr. Press, Inches $H_2O$ | Maintained Positive Under 3 | | |
| Min. Trans. (Tm), % | 82 | 82 | 86 |
| at, minutes | 14.0 | 6.0 | 9.0 |
| Max. Spec. Opt. Dens. (Dm) | 11 | 9 | 9 |
| Clear Beam, Dc. | 1 | 1 | 1 |

-continued

SMOKE DENSITY TEST (ASTM E662)

| | | | | |
|---|---|---|---|---|
| Avg. | | | | |
| Dm, corrected (Dmc) | 10 | 8 | 8 | 8.7 |
| Spec. Opt. Density at 1.5 min. | 3 | 4 | 4 | 3.7 |
| Spec. Opt. Density at 4.0 min. | 7 | 7 | 7 | 7.0 |
| Time to 90% DM, min. | 7.0 | 4.0 | 4.8 | |
| Time to Ds = 16, min. | — | — | — | |
| Initial Weight, grams | 1.9 | 1.9 | 1.9 | |

FLAMMABILITY TEST
1. National Fire Protection Association Standard 701 Small Scale Test 1989.

| After Flame (seconds) | | Char Length (inches) | | Flaming Residues (seconds) | |
|---|---|---|---|---|---|
| Warp | Filling | Warp | Filling | Warp | Filling |
| 0.0 | 0.0 | 0.7 | 0.9 | 0.0 | 0.0 |
| 0.0 | 0.0 | 0.9 | 0.7 | 0.0 | 0.0 |
| 0.0 | 0.0 | 0.8 | 0.8 | 0.0 | 0.0 |
| 0.0 | 0.0 | 0.8 | 0.6 | 0.0 | 0.0 |
| 0.0 | 0.0 | 0.8 | 0.8 | 0.0 | 0.0 |
| | | Overall Avg. 0.8 | | | |

2. NFPA 701-89, Large Scale Test
TEST RESULTS

| Specimen | Direction | Dimensions, Inches | Char Length, Inches | After Burn, Seconds |
|---|---|---|---|---|
| 1 | Machine | 5 × 84 | 0 | 0 |
| 2 | Machine | 5 × 84 | 0 | 0 |
| 3 | Machine | 5 × 84 | 1 | 0 |
| 4 | Machine | 5 × 84 | 1 | 0 |
| 5 | Machine | 5 × 84 | 1 | 0 |
| 6 | Cross Machine | 5 × 84 | 0 | 0 |
| 7 | Cross Machine | 5 × 84 | 2 | 0 |
| 8 | Cross Machine | 5 × 84 | 1 | 0 |
| 9 | Cross Machine | 5 × 84 | 0 | 0 |
| 10 | Cross Machine | 5 × 84 | 0 | 0 |

Observation: Charring

Requirements

A material tested in single sheets shall not continue flaming for more than two seconds after the test flame is removed. The vertical spread of burning shall not exceed 10 inches above the tip of the test flame. Portions of residues of textiles or films which break or drip from the test specimen shall not continue to flame after they reach the floor of the tester.

Conclusion

The submitted sample meets the requirements when tested per NFPA 701-89 (Single Sheets) as indicated above.

Thus, it is possible to produce in accordance with the present invention improved flexible fabrics and smoke curtains made therefrom which exhibit extremely high flame retardant properties, yet produce very little toxic fumes upon exposure to heat or flame.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A flexible, smoke impermeable fabric comprised of a woven fiberglass fabric substrate having a smoke impervious coating on at least one side thereof, said coating comprising a halide-free resin binder and a halide-free fire retardant incorporated therein, said fabric having a flexural rigidity of less than 0.030 in-lbs. in the warp direction and less than 0.015 in-lbs. in the fill direction when tested in accordance with ASTM D 1388.

2. The fabric of claim 1, wherein said coating comprises a halide-free acrylic or silicone resin binder having a halide-free flame retardant dispersed therein.

3. The fabric of claim 2, wherein said flame retardant is aluminum hydrate.

4. The fabric of claim 1, wherein said coating is on both sides of said substrate.

5. The fabric of claim 1, having an $LC_{50}$ of greater than 20 grams.

6. The fabric of claim 1, having an $LC_{50}$ of greater than 50 grams.

7. The fabric of claim 1, wherein said substrate is formed of fiberglass filaments having an average diameter of less than about 0.00040 per inch.

8. The fabric of claim 1 wherein the yarns forming said fabric have a strand count of at least 3,700 yards/pound.

9. The fabric of claim 1, wherein said resin binder has a $T_{300}$ of less than −10° C.

10. The fabric of claim 1, wherein said resin binder contains a silicone resin and a silicone softener.

11. A flexible, smoke impermeable smoke curtain comprised of a woven fiberglass fabric substrate coated on at least one side with a coating which contains a fire retardant therein and wherein both the coating and the fire retardant are essentially free of halogen containing compounds, said curtain having no rigid backing and including attachment devices adapted to secure said curtain to a supporting frame, said curtain having a flexural rigidity of less than 0.030 in-lbs. in the warp direction and less than 0.015 in-lbs. in the fill direction when tested in accordance with ASTM D 1388.

12. The curtain of claim 11, wherein said coating consists essentially of compounds free of nitrogen, sulfur, chlorine, bromine and fluorine atoms.

13. The curtain of claim 12, wherein said flame retardant is aluminum hydrate.

14. The curtain of claim 11, wherein said coating is on both sides of said substrate.

15. The curtain of claim 11, having an $LC_{50}$ of greater than 20 grams.

16. The curtain of claim 11, having an $LC_{50}$ of greater than 50 grams.

17. The curtain of claim 11, wherein said substrate is formed of fiberglass filaments having an average diameter of less than about 0.00040 per inch.

18. The curtain of claim 17, wherein the yarns forming said fabric substrate have a yarn count of 3,700 yards/pound.

19. The curtain of claim 11, wherein said coming comprises a resin binder having a $T_{300}$ of less than −10° C.

20. The curtain of claim 11, wherein said coating contains a silicone resin and a silicone softener.

21. A flexible, smoke impermeable fabric useful in producing a smoke curtain comprised of a tightly woven fiberglass fabric substrate formed of fiberglass filaments having an average diameter of less than about 0.00040 inch, and a halide-free coating on both sides of said fabric, said coating having a flexural rigidity of less than 0.030 in-lbs. in the warp direction and less than 0.015 in-lbs. in the fill direction when tested in accordance with ASTM D 1388, said coating further comprising a resin binder having a $T_{300}$ of less than −10° C.

22. A smoke curtain formed from the fabric of claim 21.

* * * * *